United States Patent [19]

Yamashita

[11] Patent Number: 4,800,795

[45] Date of Patent: Jan. 31, 1989

[54] ELECTRONIC DRUM WITH ANGLE ADJUSTMENT

[75] Inventor: Toshinori Yamashita, Shizuoka, Japan

[73] Assignee: Nippon Gakki Seizo Kabushiki Kaisha, Shizuoka, Japan

[21] Appl. No.: 183,373

[22] Filed: Apr. 11, 1988

Related U.S. Application Data

[63] Continuation of Ser. No. 71,522, Jul. 9, 1987, abandoned, which is a continuation of Ser. No. 794,061, Nov. 1, 1985, abandoned.

[30] Foreign Application Priority Data

Nov. 8, 1984 [JP] Japan ..... 59-168583[U]

[51] Int. Cl.[4] ..... G10D 13/02

[52] U.S. Cl. ..... 84/421; 248/288.3; 248/481

[58] Field of Search ..... 84/411 R, 421; 248/288.3, 276, 481

[56] References Cited

U.S. PATENT DOCUMENTS

| | | | |
|---|---|---|---|
| 2,439,009 | 4/1948 | Kujawski | 248/276 |
| 2,746,354 | 5/1956 | Barkley | 248/276 |
| 3,509,264 | 12/1967 | Green | 84/421 X |
| 3,576,149 | 4/1971 | Slingerland, Jr. | 84/421 |
| 4,158,981 | 6/1979 | Kurosaki | 84/421 |

OTHER PUBLICATIONS

Japanese Utility Model Laid Open Specification No. Sho 53-26124.

*Primary Examiner*—L. T. Hix
*Assistant Examiner*—Brian W. Brown
*Attorney, Agent, or Firm*—Blakely, Sokoloff, Taylor & Zafman

[57] ABSTRACT

An angle adjusting apparatus for a percussion instrument has a ball member and a seat in slidable contact with the ball member. One of the ball member and the seat is mounted on a musical instrument support member of a musical instrument stand. The other of the ball member and the seat is mounted integrally with a musical instrument housing. Such construction of the angle adjusting apparatus makes a player's angle adjusting work of the percussion instrument easier, so that the player has no need to adjust it in an unnatural posture.

11 Claims, 3 Drawing Sheets

ELECTRONIC DRUM WITH ANGLE ADJUSTMENT

This is a continuation of application Ser. No. 71,522 filed July 9, 1987, abandoned, which is a continuation of application Ser. No. 794,061 filed Nov. 1, 1985 abandoned.

BACKGROUND OF THE INVENTION

The present invention relates to an angle adjusting apparatus for a percussion instrument.

A percussion instrument of this type can be pivoted in any direction by an angle adjusting apparatus mounted on a percussion instrument stand or an arm extending from a percussion instrument stand near the percussion instrument and can be set at a proper angle for best musical performance.

However, since a conventional angle adjusting apparatus is normally mounted on the percussion instrument stand or the arm extending from the percussion instrument stand near the percussion instrument, a player must adjust an angle of a percussion instrument housing at a position away from the percussion instrument. In this sense, the player must adjust the angle in an unnatural posture. For example, the player must adjust the angle while he stretches his arm or must operate the adjustment apparatus while his hand is concealed at the rear side of the percussion instrument. When the player does not wish adjustment with an unnatural posture, the percussion instrument stand must be pulled toward him and the inclination angle of the percussion instrument can then be performed.

Furthermore, when the player adjusts an angle of the housing at a position away therefrom, especially, when he wishes to perform fine adjustment of a percussion surface of a drum or the like, he repeatedly stretches his arms to perform adjustment, resulting in cumbersome adjustment.

In a conventional angle adjusting apparatus, unnecessary vibrations during musical performance, that is, stand vibrations caused upon striking of a drum or the like and external vibrations transferred from a floor surface through the stand cannot be sufficiently absorbed, and unnecessary vibrations are often picked up as noise by the percussion instrument.

SUMMARY OF THE INVENTION

It is, therefore, a principal object of the present invention to provide an angle adjusting apparatus for a percussion instrument, wherein an angle of a musical instrument housing can be relatively easily performed without causing a player to take an unnatural posture.

It is another object of the present invention to provide an angle adjusting apparatus for a percussion instrument, wherein fine adjustment can be performed with high precision.

In order to achieve the above objects of the present invention, an angle adjusting apparatus is built into a percussion instrument housing.

According to an aspect of the present invention, there is provided an angle adjusting apparatus for a percussion instrument, comprising a ball member and a seat in slidable contact with the ball member, one of which is mounted on a musical instrument support member of a musical instrument stand, and the other of which is mounted integrally with a musical instrument housing.

BRIEF DESCRIPTION OF THE DRAWINGS

FIG. is a sectional view of an electronic drum showing an embodiment of an angle adjusting apparatus for a percussion instrument according to the present invention.

DESCRIPTION OF THE PREFERRED EMBODIMENTS

Figure 1:
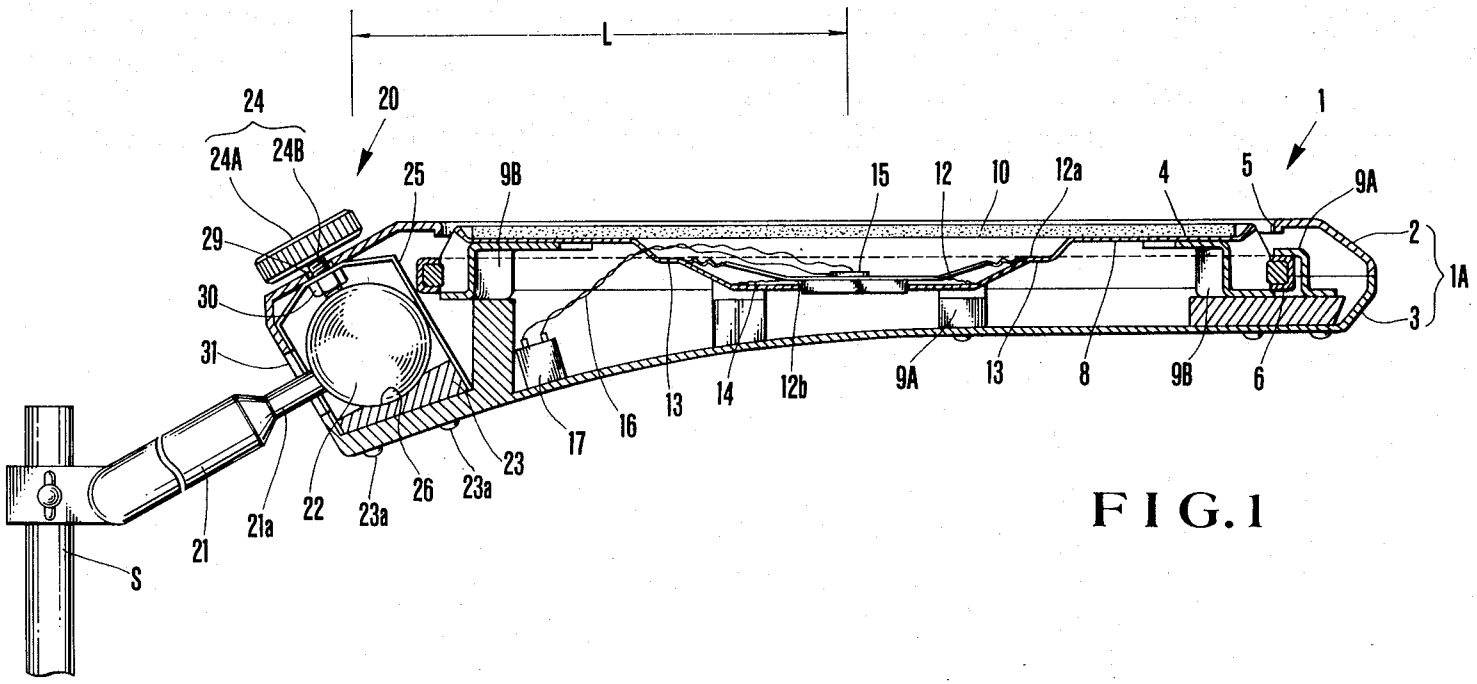

FIG. 1 shows a case wherein an angle adjusting apparatus for a percussion instrument of the present invention is applied to an electronic drum. Referring to FIG. 1, reference numeral 1 denotes an electronic drum. The electronic drum 1 has upper and lower covers 2 and 3 which are integrally coupled by a fastening means such as set screws. The upper and lower covers 2 and 3 constitute a resonance body 1A. A drum head 4 is arranged inside the resonance body 1A to close an opening formed at the center of the upper cover 2.

The drum head 4 is kept taut with a substantially uniform tension force throughout the surface. The peripheral portion of the drum head 4 is fixed and held by a head frame 6. The head frame 6 is supported by a support member 9A fixed on the lower cover 3 constituting the resonance body 1A. A closed space forming member 8 is fixed on a support member 9B to support the lower surface of the peripheral portion of the drum head 4. A flexible member 10 of a material such as a foamed material such as a foamed resin or sponge is placed on the closed space forming member 8. The upper surface of the flexible member 10 is in tight contact with the lower surface of the drum head 4. The central portion of the closed space forming member 8 extends downward, so that a proper space is formed between the closed space forming member 8 and the flexible member 10. A conical vibration plate 12 is placed in the space. An edge **12*a* of the vibration plate 12 is fixed on a step 13 formed in a portion of the closed space forming member 8 intermediate along the depth direction. A peripheral portion of a neck 12*b* is supported by a damper 14 fixed on the inner bottom surface of the closed space forming member 8. A piezoelectric element 15 is fixed on the center of the surface of the vibration plate 12 to convert a vibration of the vibration plate 12 to an electrical signal. The piezoelectric element 15 is connected to a jack 17 through a wiring 16**.

When a player strikes the drum head 4 with sticks, a vibration is transferred to the vibration plate 12 through air closed in the space defined by the flexible member 10 and the vibration plate 12. The vibration from the vibration plate 12 is converted by the piezoelectric element 15 to an electrical signal. According to this signal representing striking information (e.g., time point, volume, etc. upon striking of a percussion instrument) such an electronic sound source as a PCM sound source which records drum sound or a FM sound source which produces drum sound is derived, so that electronic sounds can be produced at a loudspeaker.

An angle adjusting apparatus 20 of the present invention is built into the resonance body 1A of the electronic drum 1. The angle adjusting apparatus 20 arbitrarily pivots the electronic drum 1 with respect to an instrument support member 21 in a musical instrument stand S. A ball member 22 inserted in the resonance body 1A is mounted at the distal end of the support member 21. The ball member 22 is made of a thermosetting resin (i.e., an elastic member) having an elastic property so as to provide a shock absorption effect. Polycarbonate resin or acetal resin is used as the thermosetting resin for the ball member 22. Glass fiber may be mixed in the material resin to increase the elasticity of the ball member 22. A seat 23 is disposed in slidable contact with the ball member 22 at a portion of the member 22 arranged inside the resonance body 1A. The seat 23 is fixed by a proper fastening means **23*a* such as screws at the inner bottom surface of the lower cover 3. A semi-spherical recess having the same radius of curvature as that of the ball member 22 is formed on the central portion of the upper surface of the seat 23, thereby constituting a ball member seat portion 26**.

The seat 23 is normally made of a metal material and preferably consists of a die cast zinc or aluminum. Alternatively, the seat 23 may be made by iron forging or iron plate pressing. Alternatively, the seat 23 may be made of the same elastic material as that of the ball member 22.

An angle adjusting screw 24 is engaged with a ball house 25 to urge the ball member 22 against the seat 23 and fix the ball member 22. The angle adjusting screw 24 consists of a knob portion 24A and a screw portion 24B. The screw portion 24B is inserted in a through hole 29 formed in the upper case 2 and is threadably engaged with a nut 30 welded on the ceiling surface of the ball house 25. The distal end of the screw portion 24B abuts against the upper surface of the ball member 22. The ball house 25 is arranged in the resonance body 1A so as to surround the ball member 22 and the seat 23.

A hole 31 is formed in one side surface of the resonance body 1A of the electronic drum 1 to receive a small-diameter portion **21*a* of the support member 21**.

In the angle adjusting apparatus 20 having the construction described above, when the player turns the angle adjusting screw 24 to strongly urge the ball member 12 against the seat portion 26, the ball member 22 comes in tight contact with the ball seat portion 26 in the seat 23, thereby interrupting sliding movement therebetween and hence firmly holding the electronic drum 1 at a predetermined angle. Furthermore, the angle adjusting apparatus 20 is mounted at the side of the electronic drum 1, and a distance L (FIG. 1) between the center of the striking surface of the drum and the angle adjusting apparatus 20 can be shortened. Therefore, fine adjustment of the striking surface position can be easily performed. A load (especially, moment) acting on the adjusting apparatus 20 can be decreased to increase mechanical strength thereof, and the adjusting apparatus has a long lifetime. Furthermore, since the ball member 22 is formed by the elastic member and serves as the shock absorbing material, vibrations transferred from the electronic drum 1 to the stand and vice versa can be absorbed, thereby increasing an S/N ratio of the output signal.

Figure 2A:
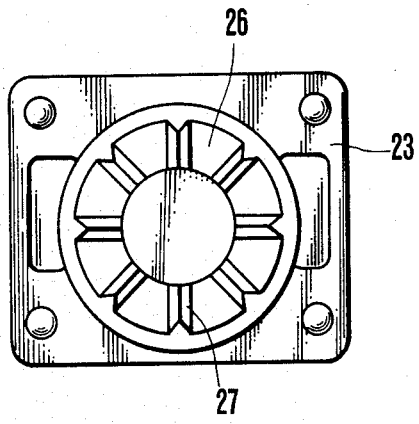
FIGS. 2A and 2B are a plan view and a partially cutaway front view of a seat according to another embodiment of the present invention.
Figure 2B:
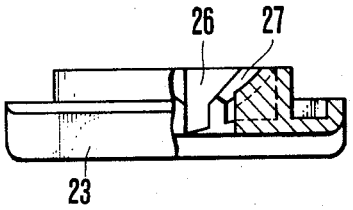

The seat 23 may comprise a plurality of projections 27 which constitute an inverted V-shaped ball seat portion 26 and each of which has the same radius of curvature as that of the ball member 22, as shown in FIGS. 2A and 2B. With this construction, the ball member 22 can be engaged well with the projections 27 as compared with a seat 23 with a semi-spherical surface. Therefore, the set angle of the electronic drum 1 during musical performance can be firmly kept.

Figure 3:
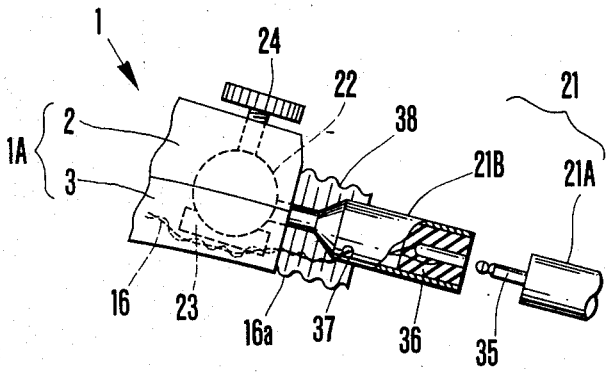
FIG. 3 is a partially cutaway side view showing another embodiment of an angle adjusting apparatus for a percussion instrument according to the present invention.

FIG. 3 shows another embodiment of the present invention. An angle adjusting apparatus 20 in an electronic drum of FIG. 3 is the same as that of FIG. 1, and a detailed description thereof will be omitted. A characteristic portion of the embodiment of FIG. 3 lies in the facts that a musical instrument support member 21 mounted with a ball member 22 is divided into two pieces, a jack 35 is attached to the distal end of a stand-side split support member 21A, a connector 36 is mounted to the proximal portion of an instrument-side split support member 21B to receive the jack 35, and a wiring 16 of a piezoelectric element 15 is connected to the connector 36.

The wiring 16 is led outside from the resonance body 1A, and then is inserted in the instrument-side split support member 21B of a pipe material through a small hole 37 formed in the surface of the member 21B. The wiring 16 is connected to the connector 36 mounted at the opening end of the member 21B. An exposed portion **16*a* of the wiring 16 which is exposed at an outer atmosphere and the distal end of the member 21B which is located at the side of the resonance body 1A are covered with a flexible cover 38 mounted on the side surface of the resonance body 1A**.

With the above construction, a power source cord connected to the electronic drum 1 can be set within the musical instrument stand. The power source cord will not suspend downward from the electronic drum 1, and it neither interferes manual angle adjustment nor is disconnected during angle adjustment.

Figure 4:
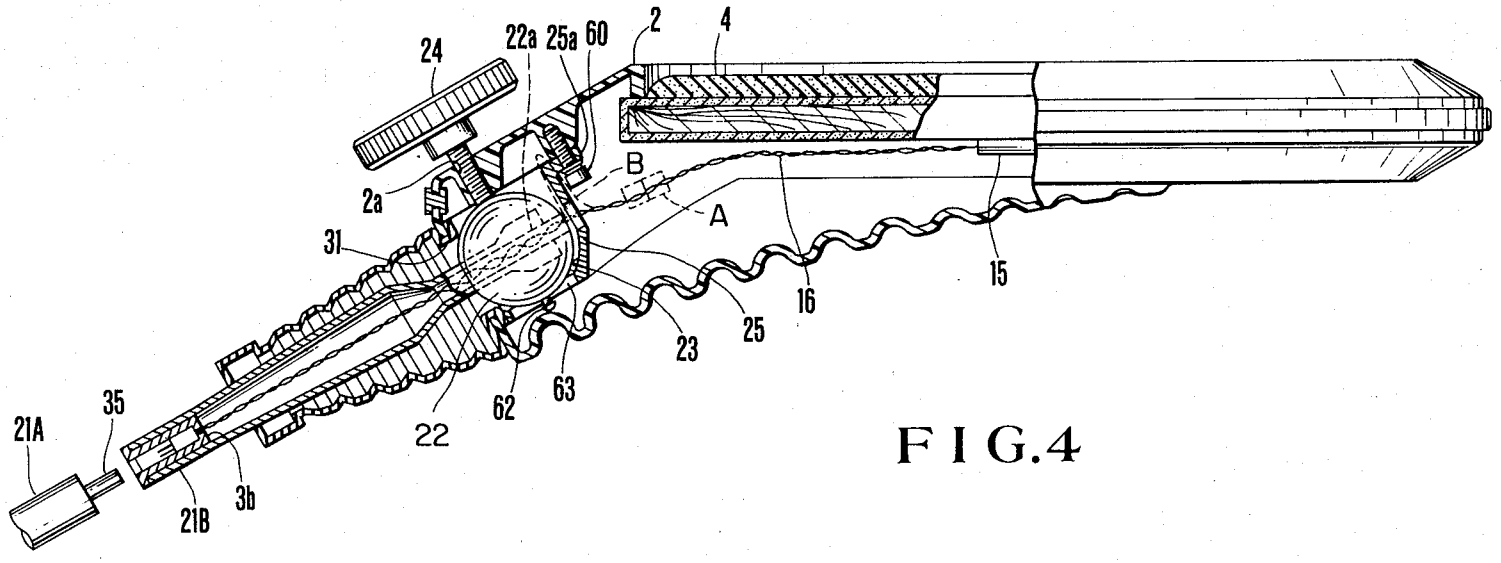
FIG. 4 is a partially cutaway side view showing still another embodiment of an angle adjusting apparatus for a percussion instrument according to the present invention.

In this case, when the wiring 16 is led to the split support member 21B through the ball member 22, the exposed portion **16*a* can be omitted, and the flexible cover 38 is not required, thus providing a good appearance. This is exemplified in FIG. 4. Referring to FIG. 4, an upper cover 2 constituting a musical instrument resonance body 1A is made of a light metal material such as aluminum, and a portion mounted with an angle adjusting apparatus 20 is inclined downward from an edge of a drum head 4. A lower cover 3 is made of a plastic material. The inclined portion of the upper cover 2 is threadably engaged with an angle adjusting screw 24 through a screw hole 2*a*. A flange 25*a* of a ball house 25 formed by a metal material such as aluminum is fixed by a fastening means such as screws 60. The ball house 25 has a structure for holding the ball member 22 together with the inner surface of the upper cover 2. The distal end of the musical support member 21 is mounted to the ball member 22 through a hole 31 formed in the side surface of the resonance body 1A. In this case, the support member 21 is divided into two pieces in the same manner as in the embodiment of FIG. 3. More specifically, the support member 21 comprises an instrument-side split support member 21B, one end of which is mounted to the ball member 22, and a stand-side split support member 21A, one end of which is connected to the support member 21B and the other end of which is connected to a musical instrument stand (not shown). The support members 21A and 21B are made of pipes. An end portion of the support member 21B at the side of the ball member 22 is tapered, and the distal end thereof comprises a flat portion embedded in the ball member 22. The ball member 22 can be formed by the same elastic material (e.g., polycarbonate resin) as in the previous embodiments together with the distal end of the support member 21. A through hole 22***a* is formed in the ball member 22 at a portion plotted along a line extended from the support member 21B. The wiring 16 from the piezoelectric element 15 mounted on the drum head 4 through the through hole 22*a* is led inside the support member 21B through its one end and to a connector 36 at its other end. The connector 36 is connected to a plug 35 to which one end of the support member 21A is connected. The wiring 16 is connected to an external circuit through the support member 21A and a musical instrument stand (not shown).

A projection such as a fixing screw 62 is formed at a suitable portion of the ball member 22 engaged with the angle adjusting screw 24 to regulate pivotal movement of the ball member 22. A hole 63 is formed in the ball house 25 to oppose the projection 62. Cooperating operation between the projection 62 and the hole 63 prevents electrical disconnections of the wiring 16 since the pivotal range of the ball member 22 is limited. A seat 23 constituting the seat portion of the ball member 22 is formed integrally with the ball house 25. More particularly, the ball member seat portion 26 constituting the seat 23 is formed on the inner surface of the ball house 25 and comprises a plurality of inverted V-shaped projections extending radially, as shown in FIG. 2.

The same effect as in the previous embodiments can be obtained in the embodiment without a further description.

In this embodiment, the wiring 16 is directly connected between the piezoelectric element 15 and the connector 36 arranged in the support member 21B. However, the wiring 16 may be coupled through a connector indicated by a dotted block A so as to simplify assembly. Furthermore, in the above embodiment, the wiring 16 is led through the through hole formed in the ball house 25, as shown in FIG. 4. However, the wiring 16 need not be led through the through hole formed in the ball house 25 but may pass by the upper edge thereof along a broken line B.

The above embodiments exemplify the electronic drums. However, the present invention is not limited to the electronic drums, but can be extended to an electrical percussion instrument having a sound source such as an electric drum wherein a vibration in a drum head is converted to an electrical signal, and the electrical signal is amplified to produce a sound. The present invention, of course, can also be applied to a natural percussion instrument.

What is claimed is:

1. An electronic drum of a type that is played by a player and is attachable to an instrument stand comprising:

a drum body having an upper surface with an opening in a center portion thereof and a peripheral extremity;

a drum head disposed over said opening;

angle adjusting means mounted on said peripheral extremity of said drum body for adjusting an angular orientation of said drum body comprising a ball housing having a seat, a ball disposed within said ball housing and resting on said seat, a rod having a first end connected to said ball and a second end connected to the instrument stand, and screw means extending through said upper surface of said drum body, said screw means selectively operable by the player for depressing said ball against said seat, thereby preventing movement of said drum body with respect to the instrument stand.

2. An electronic drum according to claim 1, wherein said seat has a spherical portion which is in slidable contact with said ball.

3. An electronic drum according to claim 2, wherein said spherical portion comprises a semi-spherical portion.

4. An electronic drum according to claim 3, wherein said spherical portion of said seat has a plurality of radial projections.

5. An electronic drum according to claim 1 wherein at least one of said ball and said seat is made of an elastic material.

6. An electronic drum according to claim 5, wherein the material is a material selected from the group consisting of polycarbonate resin and acetal resin.

7. An electronic drum according to claim 6, wherein the material comprises a material prepared by mixing a fiber material in one of the polycarbonate resin and acetal resin.

8. An electronic drum according to claim 1, wherein said rod is tubular.

9. An electronic drum according to claim 8, wherein said drum body and said drum head comprise an electronic drum.

10. An electronic drum according to claim 9, wherein wiring for connecting said electronic drum to an external circuit is led through said tubular rod.

11. An electronic drum according to claim 10, wherein a through hole is formed in a wall of said tubular rod and said wiring is led from said external circuit to said electronic drum through said through hole.

* * * * *

UNITED STATES PATENT AND TRADEMARK OFFICE

CERTIFICATE OF CORRECTION

PATENT NO. : 4,800,795

DATED : 01/31/89

INVENTOR(S) : Yamashita

It is certified that error appears in the above-identified patent and that said Letters Patent is hereby corrected as shown below:

| COLUMN | LINE | |
|---|---|---|
| 02 | 03 | after "FIG." insert --1-- |
| 03 | 48 | delete "12" insert --22-- |
| 06 | 34 | delete "the material" insert --the elastic material-- |

Signed and Sealed this

Sixth Day of February, 1990

*Attest:*

JEFFREY M. SAMUELS

*Attesting Officer*

*Acting Commissioner of Patents and Trademarks*